US007490592B2

(12) United States Patent
Kaneko

(10) Patent No.: US 7,490,592 B2
(45) Date of Patent: Feb. 17, 2009

(54) FUEL INJECTION APPARATUS FOR ENGINE AND METHOD OF OPERATING THE ENGINE EQUIPPED WITH THE APPARATUS

(75) Inventor: Takashi Kaneko, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/819,623

(22) Filed: Jun. 28, 2007

(65) Prior Publication Data

US 2008/0127942 A1 Jun. 5, 2008

(30) Foreign Application Priority Data

Nov. 30, 2006 (JP) ..... 2006-324640

(51) Int. Cl.
*F02M 37/06* (2006.01)
*F02M 37/00* (2006.01)

(52) U.S. Cl. ..... 123/506; 123/508

(58) Field of Classification Search ..... 123/456, 123/508, 500, 506, 507, 499, 458, 495, 502, 123/503
See application file for complete search history.

(56) References Cited

U.S. PATENT DOCUMENTS 4,777,921 A 10/1988 Miyaki et al.
5,201,294 A * 4/1993 Osuka ..... 123/458
6,135,090 A * 10/2000 Kawachi et al. ..... 123/446
6,343,588 B1 * 2/2002 Onishi et al. ..... 123/506
6,505,608 B2 * 1/2003 Hiraku et al. ..... 123/458
6,546,917 B2 * 4/2003 Onishi et al. ..... 123/506
6,651,630 B2 * 11/2003 Hiraku et al. ..... 123/506
6,701,898 B2 * 3/2004 Tokuo et al. ..... 123/456
2002/0033167 A1 * 3/2002 Hiraku et al. ..... 123/456
2006/0118089 A1 * 6/2006 Tokuo et al. ..... 123/458
2006/0157032 A1 * 7/2006 Hori ..... 123/458

FOREIGN PATENT DOCUMENTS

JP 62-258160 A 11/1987
JP 64-73166 A 3/1989

* cited by examiner

*Primary Examiner*—Mahmoud Gimie
(74) *Attorney, Agent, or Firm*—Birch, Stewart, Kolasch & Birch, LLP

(57) ABSTRACT

A fuel injection apparatus with which energy for driving the high pressure fuel pumps of the apparatus by proper operation of the high pressure fuel pumps in order to reduce waste energy, and a method of operating an engine equipped with the apparatus, are provided. The apparatus is provided with a controller which allows some of the plurality of high pressure fuel pumps to be made inoperative in discharging fuel to the common rail by controlling the electromagnetic valves of said some of the pumps so that the plunger rooms of said some of the pumps are communicated to a fuel feed line for feeding fuel to the plurality of the pumps when the engine is operated with small/medium fuel injection quantity of smaller than a certain quantity.

9 Claims, 6 Drawing Sheets

(A)

(B)

FUEL INJECTION APPARATUS FOR ENGINE AND METHOD OF OPERATING THE ENGINE EQUIPPED WITH THE APPARATUS

BACKGROUND OF THE INVENTION

1. Field of the Invention

The present invention relates to a fuel injection apparatus and applied to a diesel engine, etc. equipped with an accumulator fuel injection apparatus, the apparatus being composed such that; high pressure fuel pumps are provided each of which compresses fuel introduced into its plunger room to high pressure by its plunger fitted in its plunger barrel and reciprocated by means of a fuel cam and discharges the compressed fuel at timing controlled by an electromagnetic valve to supply the compressed fuel to a common rail, and high pressure fuel accumulated in the common rail is injected periodically at determined injection timing into each of the cylinders of the engine, and a method of operating the engine equipped with the apparatus.

2. Description of the Related Art

An accumulator fuel injection equipment used in a diesel engine is provided with high pressure fuel injection pumps each of which compresses fuel introduced into its plunger room to high pressure by its plunger fitted in its plunger barrel and reciprocated by means of a fuel cam, and high pressure fuel accumulated in a common rail is supplied to each of fuel injection valves to be injected periodically at determined injection timing into each engine cylinder.

In an accumulator fuel injection apparatus like this, discharge duration of high pressure fuel from each of the high pressure pumps is controlled by controlling opening/closing of a low pressure side fuel feed passage by means of an electromagnetic valve provided to each pump as disclosed for example in Japanese Laid-Open Patent Application No. 64-73166 (patent literature 1) and Japanese Laid-Open Patent Application No. 62-258160 (patent literature 2).

In FIG. 3B represents a diagram showing a fuel cam lift and opening/closing of the electromagnetic valve vs. crankshaft rotation angles in the electronically-controlled accumulator fuel injection apparatus disclosed in the patent literature 1.

In FIG. 3B, the fuel cam lifts and opening/closing timing of two high pressure fuel pumps among a plurality of the high pressure fuel pumps are shown. As shown in the drawing, the conventional electronic control accumulator fuel injection apparatus is composed such that the plurality of high pressure fuel injection pumps (No. 1 pump and No. 2 pump in this example of FIG. 3B) operate in the same operation condition all over engine operating range, the electromagnetic valve is closed on the way the cam lift is increasing to begin fuel discharge from the high pressure fuel pump, and opened when the cam lift is near its maximum to allow high pressure fuel in the plunger room of the high pressure pump to spill out to the fuel feed line (low pressure side fuel line).

In prior arts disclosed in the patent literature 1, and 2, etc., as shown in FIG. 3B, all of a plurality of high pressure fuel pumps (No. 1 and No. 2 pumps in this example) are operated to discharge fuel by closing their electromagnetic valves and to allow remaining high pressure fuel in the plunger room to spill to the fuel feed line at injection end by opening their electromagnetic valves in all over the engine operation range.

The number of discharging and spilling is determined by the product of the rotation number of the fuel cam, the number of cam lobes per fuel cam, and the number of the plungers.

As the high pressure fuel remaining in the plunger when fuel injection ends is spilled to the fuel feed line, the energy consumed to compress the spilled fuel is wasted to the fuel feed side.

As mentioned above, in the prior arts, all of the high pressure fuel pumps discharge high pressure fuel to the common rail and the high pressure fuel remaining in each of the plunger room at the end of fuel injection from each injection nozzle is spilled by opening each electromagnetic valve, so that the energy consumed to compress the spilled fuel is wasted to fuel feed side, resulting in decreased energy efficiency.

SUMMARY OF THE INVENTION

The present invention was made in light of the problems of prior art, and the object is to provide a fuel injection apparatus with which energy for driving the high pressure fuel pumps of the apparatus is decreased by proper operation of the high pressure fuel pumps depending on engine loads in order to reduce waste energy, and a method of operating an engine equipped with the apparatus, thereby increasing energy efficiency of the engine.

To attain the object, the invention proposes a fuel injection apparatus for engines comprising a plurality of high pressure fuel pumps in each of which fuel supplied to a plunger room is compressed by a plunger driven by a fuel cam to reciprocate in a plunger barrel, the compressed fuel being discharged to a common rail at timing controlled by an electromagnetic valve, high pressure fuel accumulated in the common rail being injected into cylinders of an engine through injection valves at controlled timing, wherein a controller is provided which allows some of the plurality of high pressure fuel pumps to be made inoperative in discharging fuel to the common rail by controlling the electromagnetic valves of said some of the pumps so that the plunger rooms of said some of the pumps are communicated to a fuel feed line for feeding fuel to the plurality of the pumps when the engine is operated with small/medium fuel injection quantity of smaller than a certain quantity.

In the invention, it is preferable that a pressure detector for detecting pressure in the common rail and inputting it to the controller, whereby the controller controls based on pressure in the common rail detected by said pressure detector the electromagnetic valves of said some of the pumps so that said some of the pumps are made inoperative in discharging fuel to the common rail when pressure in the common rail is lower than a certain pressure in low/medium load operation of the engine.

The invention proposes a method of fuel injection apparatus for engines comprising a plurality of high pressure fuel pumps in each of which fuel supplied to a plunger room is compressed by a plunger driven by a fuel cam to reciprocate in a plunger barrel, the compressed fuel being discharged to a common rail at timing controlled by an electromagnetic valve, high pressure fuel accumulated in the common rail being injected into cylinders of an engine through injection valves at controlled timing, wherein some of the plurality of high pressure fuel pumps are made inoperative in discharging fuel to the common rail by controlling electromagnetic valves of said some of the pumps so that plunger rooms of said some of the pumps are communicated to a fuel feed line and high pressure fuel is supplied to the common rail by the remaining high pressure fuel pumps when the engine is operated under low/medium loads lower than a certain load.

According to the invention, when the engine is operated under a range of load lower than a certain load (low/medium load), i.e. when fuel injection quantity is smaller than a certain quantity, or common rail pressure is lower than a certain pressure i.e. low/medium pressure, the controller controls electromagnetic valves of some of the plurality of high pressure pumps to be open so that the plunger rooms of said some of the pumps are communicated to a fuel feed line to make said some of the pumps inoperative in discharging fuel to the common rail, so the amount of fuel spilled from the plunger rooms when the electromagnetic valves are opened at the end of fuel discharge is reduced compared with the apparatus of prior art, for the pumps made inoperative do not spill fuel.

That is, according to the invention, when operating the engine under a range of low/medium load, some of the high pressure fuel pumps is made inoperative by opening the relevant electromagnetic valves, and the remaining high pressure pumps discharge to the common rail fuel of quantity required to allow fuel injection quantity corresponding to engine load to be injected into the cylinders. By this, required quantity of fuel is discharged from the remaining high pressure pumps, and spilling of fuel from the pumps made inoperative do not occur which occurred conventionally, so energy wasted by spilling of fuel from the pumps made inoperative which occurs in the apparatus of prior art is saved.

Therefore, energy wasted by allowing high pressure fuel remaining in the plunger rooms to spill to the fuel feed line is reduced as compared with the conventional art, and energy for driving the high pressure fuel pumps can be reduced, resulting in increased energy efficiency of the fuel injection apparatus.

Required quantity of fuel to be supplied to the common rail to allow injection quantity of fuel needed to be injected into the engine cylinders, can be discharged from the pumps made operative by increasing discharge quantity of each of the pumps made operative.

In the invention, it is preferable to compose as follows:

(1) The controller determines beforehand order of the high pressure fuel pumps to be made inoperative in discharging fuel to the common rail when pressure in the common rail is in a range of low/medium pressure and controls the electromagnetic valves so that the high pressure fuel pumps are made inoperative in the predetermined order.

By composing like this, the electromagnetic valves are controlled such that each of the high pressure pumps is made inoperative in predetermined order when common rail pressure is in a range of low/medium pressure, so uneven operation of a specific high pressure fuel pump can be evaded, occurrence of wear and erosion to the plunger of the specific pump can be prevented, resulting in elongated life time of the high pressure fuel pumps.

It is possible in above composition that said some of the plurality of high pressure fuel pumps are made inoperative in discharging fuel to the common rail by always closing the electromagnetic valve of said some of the pumps so that fuel supply to the plunger rooms of said some of the pumps is interrupted.

(2) Abnormality detecting means for detecting abnormality of each of the plurality of high pressure fuel pumps and inputting the result of detection to the controller are provided, whereby the controller controls such that high pressure fuel pumps other than those pumps that are detected abnormal when the engine is operated with small/medium fuel injection quantity are made operative.

It is preferable that the abnormality detecting means are discharge pressure detecting means each of which detects discharge pressure of each of the plurality of high pressure fuel pumps and inputs the detected pressure to the controller.

With this composition, high pressure fuel pumps abnormal in operation such as abnormal reduction in discharge fuel pressure can be detected early by the abnormality detecting means such as discharge pressure detecting sensors, and stable operation of the engine can be continued by excluding the abnormal pumps from operation.

(3) Abnormality detecting means for detecting abnormality of each of the plurality of high pressure fuel pumps and inputting the result of detection to the controller are provided, whereby the controller controls such that high pressure fuel pumps other than the pumps detected to be abnormal by the abnormality detecting means when the engine is operated with small/medium fuel injection quantity are made operative in discharging fuel to the common rail, and maximum output of the engine is restricted in accordance with the number of high pressure fuel pumps made inoperative.

With this composition, burdens on normally operating high pressure fuel pumps can be restricted by restricting maximum engine output, operation of the high pressure fuel pumps can be continued in safety, and stable engine operation can be continued.

DETAILED DESCRIPTION OF THE PREFERRED EMBODIMENTS

Preferred embodiments of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
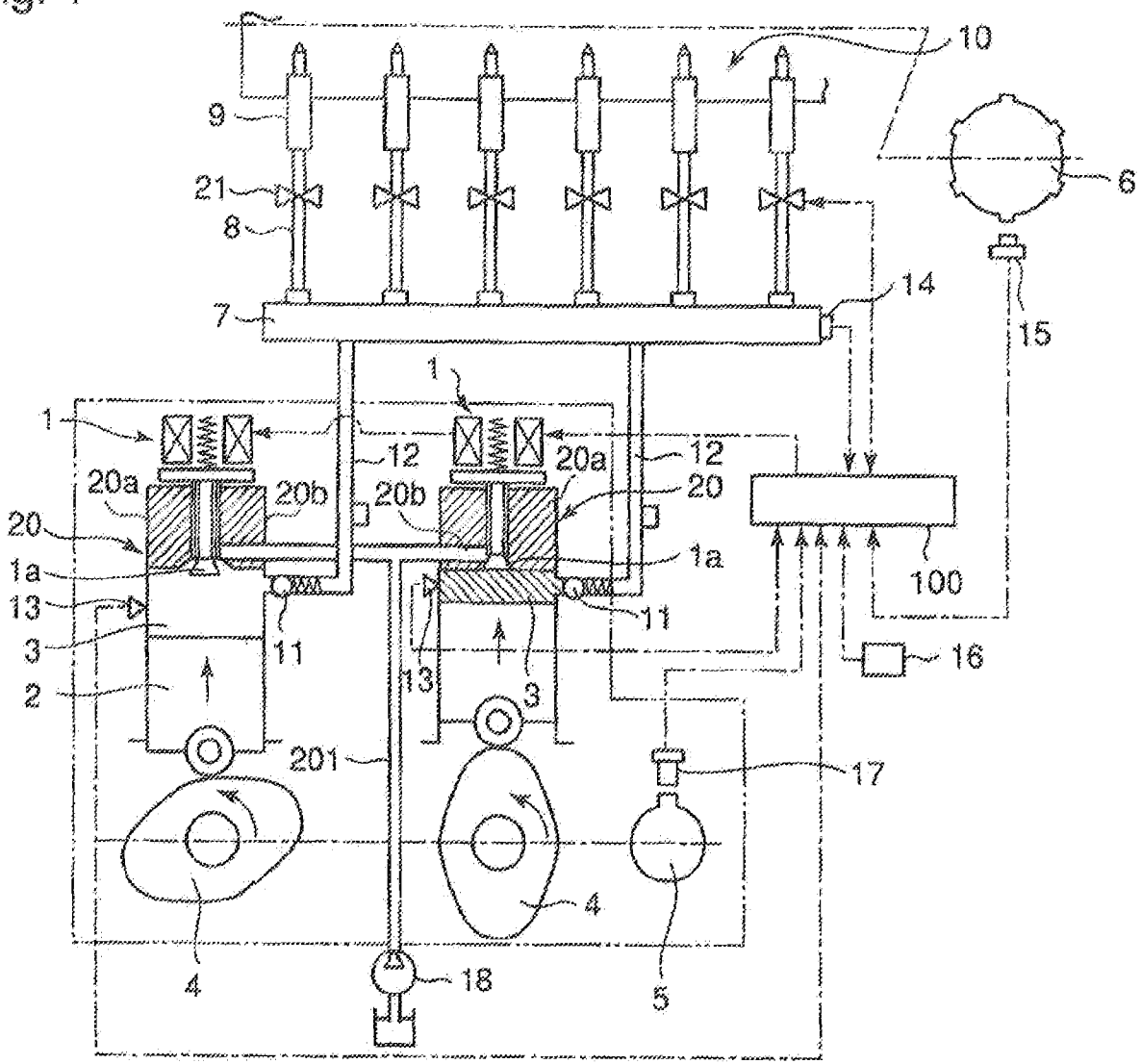
FIG. 1 is schematic representation of over-all configuration of an embodiment of the electronically-controlled accumulation fuel injection apparatus for a diesel engine according to the invention.
Figure 2:
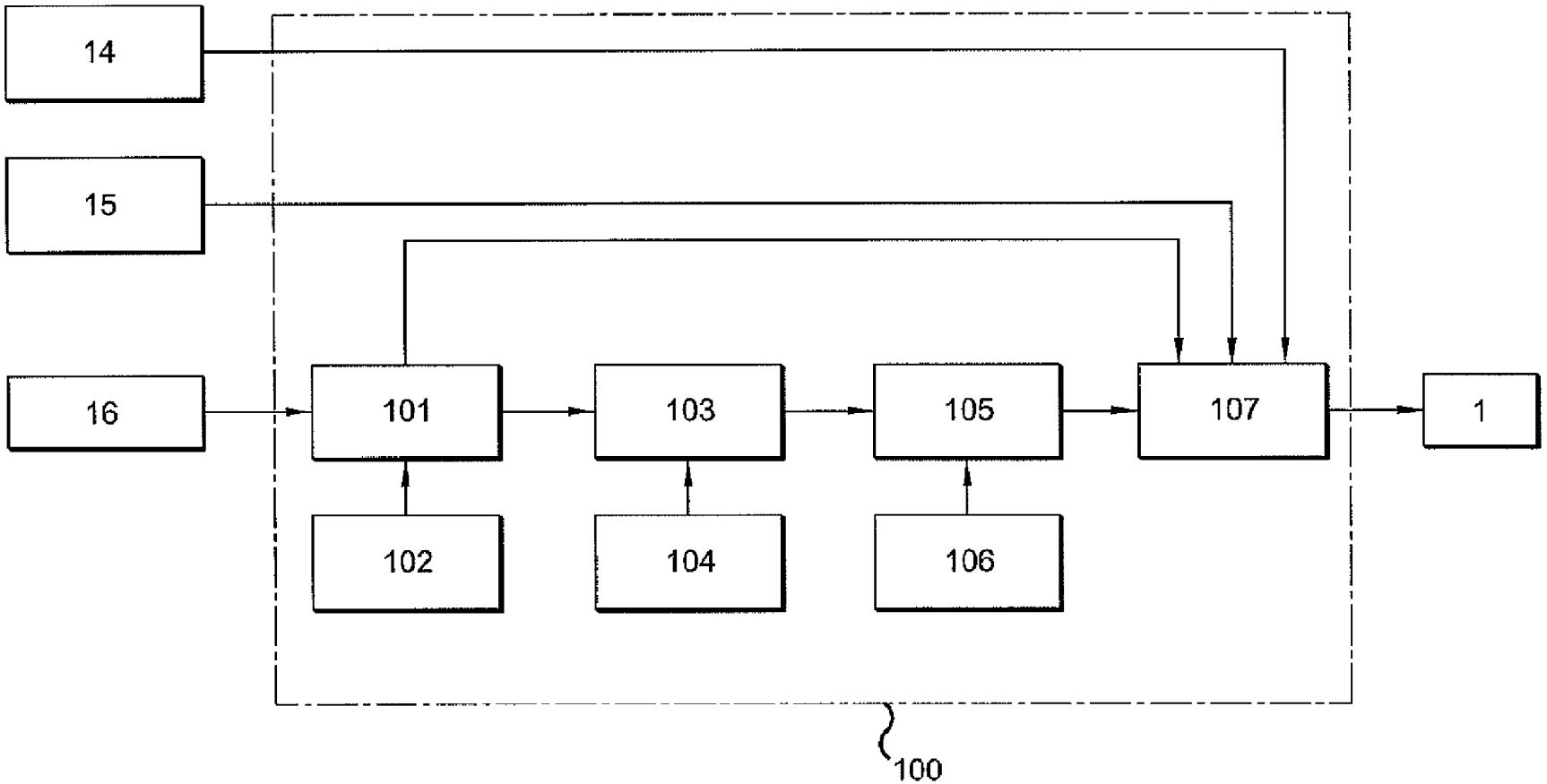
FIG. 2 is a control block diagram of the high pressure fuel pumps of the apparatus of FIG. 1.

FIG. 1 is schematic representation of over-all configuration of an embodiment of the electronically-controlled accumulation fuel injection apparatus for a diesel engine according to the invention.

Referring to FIG. 1, a plurality of high pressure pumps 20 (two pumps in this example) are provided. Each of the high pressure pumps 20 has a plunger barrel 20*a* and a plunger 2 fitted in the plunger barrel 20*a* for reciprocation. Each of the plungers 2 is driven to reciprocate in each of the plunger barrels 20*a* by a fuel cam formed on a camshaft 5 to correspond to each of the high pressure pumps 20, and compresses fuel supplied to each of plunger rooms 3.

A discharge pipe 12 of each of the high pressure pumps 20 connects each of the plunger rooms 3 to a common rail 7. A check valve 11 is provided at the outlet of the plunger room to the discharge pipe so that fuel can flow only in direction from the plunger room 3 to the common rail 7.

Fuel is supplied to the plunger rooms 3 by means of a fuel feed pump 18 via a fuel feed pipe 201 and each of fuel inlet passages 20*b* provided to each of the plunger barrels 20*a*. Each of the fuel inlet passages 20*b* is opened or closed by a poppet valve 1*a* of each of electromagnetic valves 1.

The fuel supplied to the common rail 7 from the high pressure pumps 20 through the discharge pipes 12 and accumulated in the common rail 7, is supplied to each of fuel injection valves 9 provided for each engine cylinder 10 through each injection pipe 8. The fuel is injected from the injection valve 9 into the engine cylinder. Injection timing and injection amount of each injection valve is controlled by each of fuel control valves 21 which are controlled by a controller 100.

The controller 100 receives a rotation angles of the crankshaft 6 detected by a crank angle sensor 15, engine loads detected by an engine load detector 16, rotation speed of the camshaft 5 detected by a cam rotation speed detector 17, a common rail pressure (fuel pressure in the common rail 7) detected by a common rail pressure detector 14, and pressure in the plunger room 3 of each of the high pressure fuel pumps 20 detected by a discharge pressure sensors 13.

The controller 100 outputs a control signal to control timing of opening and closing of the electromagnetic valve 1 of each of the high pressure pumps 20 based on the detected values. The controller 100 has also a function of adjusting fuel injection timing and quantity of the injection valves 9 by controlling the fuel control valves 21 based on the detected values.

In operation of a diesel engine equipped with the accumulation fuel injection apparatus constructed as mentioned above, fuel supplied by the fuel feed pump 18 through the fuel feed pipe 201 is allowed to enter the plunger room 3 through the fuel inlet passage 20*b* during a period the inlet passage is opened by the poppet valve 1*a* of the electromagnetic valve 1 which is actuated by a command signal from the controller 100.

When the inlet passage 20*b* is closed by the poppet valve 1*a* of the electromagnetic valve 1 by a command signal from the controller 100, fuel in the plunger room 3 is compressed by moving up of the plunger 2 driven by the fuel cam 4, as shown in the right side pump in FIG. 1, and supplied to the common rail 7 passing through the check valve 11 and discharge pipe 12 to be accumulated in the common rail 7.

High pressure fuel accumulated in the common rail 7 is injected from the fuel injection valve 9 into each engine cylinder 10 at controlled injection timing.

When the electromagnetic valve 1 is opened by a control signal from the controller 100, high pressure fuel in the relevant plunger room 3 spills out to the fuel feed pipe 201.

Figure 7:
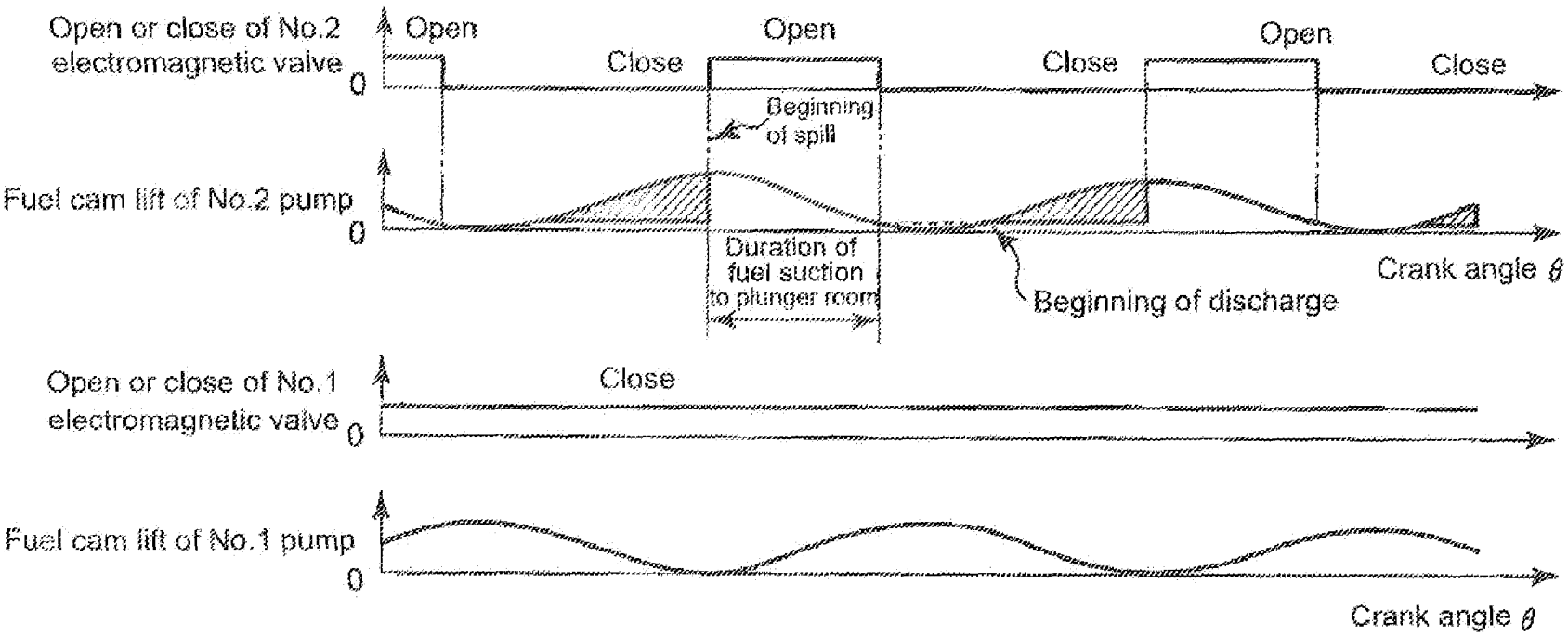
FIG. 7 is a drawing as in FIG. 3A in the case of another embodiment of the invention.

As mentioned above, in the invention, the electromagnetic valve 1 is opened at the maximum lift of the fuel cam and fuel is spilled in all over the engine operation range as shown in FIG. 3A and FIG. 7.

In the invention, the fuel injection apparatus composed and operated as mentioned above is controlled such that, in low and medium load operation of the engine, that is, the amount of fuel injection is smaller than a certain amount, the controller 100 controls electromagnetic valves 1 of some of the plurality of the high pressure fuel pumps 20 to open their poppet valves 1*a* to allow fuel in the relevant plunger rooms to be communicated with the fuel feed pipe 201 so that the relevant high pressure fuel pumps are inoperative, i.e. do not work to discharge fuel to the common rail 7.

Further, it is also suitable to make some of the high pressure fuel pumps 20 to be inoperative by preventing introduction of fuel into the plunger rooms of the pumps by closing the electromagnetic valves 1 of the pumps, as shown in FIG. 7.

Next, operation of the high pressure fuel pumps when the engine is operated under a range of low/medium load, i.e. when the amount of fuel injection is smaller than a certain amount, will be explained with reference to FIG. 2 to 5.

The engine load detected by the engine load detector 16 is inputted to a fuel injection quantity determining section 101 of the controller 100. Fuel injection quantity for various engine loads are set or calculated in a fuel injection quantity/engine load setting section 102.

Common rail pressure (fuel pressure in the common rail 7) detected by the common rail pressure sensor 14 may be used as a control factor for controlling the electromagnetic valves depending on engine loads.

The fuel injection quantity determining section 101 determines quantity of fuel injection in accordance with a detected engine load by calculation in the fuel injection quantity/engine load setting section 102 or extracting from the section 102 and inputs it to a determining section 103 of number of plungers-to-be-used (plungers of high pressure fuel pumps to be made operative in discharging fuel to the common rail).

Relation between the number of plungers, i.e. number of the high pressure pumps 20 required to be allowed to be operative in order to inject required quantity of fuel injection is set in a setting section 104 of number of plungers/injection quantity, based on fuel injection quantity and maximum fuel discharge quantity of the high pressure fuel pump 20.

The determining section 103 of number of plungers-to-be-used determines the number of high pressure fuel pumps 20, that is, number of plungers needed to discharge fuel to the common rail 7 to allow injection of fuel injection quantity corresponding with a detected engine load by calculation in the setting section 104 of number of plungers/injection quantity or extracting from the section 104, and inputs the result of determination to a determining section 105 of plunger-to-be-used.

In a setting section 106 of order of plunger-to-be-used is set order of high pressure fuel pumps among the plurality of high pressure fuel pumps 20 to be made inoperative in discharging fuel by opening their poppet valves 1*a* in a range of low/medium load operation of the engine, that is, order of the high pressure fuel pumps among the pumps 20 to be made operative in discharging fuel by closing their poppet valves 1*a* in a range of low and medium load operation of the engine.

The determining section 105 of plunger-to-be-used determines order of the high pressure fuel pumps 20 to be operated to discharge fuel upon receiving the number of plungers determined by the determining section 103 of number of plungers-to-be-used by calculation in the setting section 106 of order of plunger-to-be-used or extracting from the section 106, and inputs the result of determination to an electromagnetic valve closing duration setting section 107.

Crank angles detected by the crank angle sensor 15 and common rail pressure detected by the common rail pressure detector 14 are inputted in the electromagnetic valve closing duration setting section 107. The electromagnetic valve closing duration setting section 107 controls opening and closing of the electromagnetic valves 1 based on the determined operation order of the high pressure fuel pumps 20, detected crank angles, and detected common rail pressure so that the poppet valves 1*a* are opened or closed at appropriate timing.

By controlling as mentioned above, the electromagnetic valves 1 of the determined number of high pressure fuel pumps among the pumps 20 are opened and closed in the determined order so that fuel quantity to be injected into the engine cylinders corresponding to engine load is discharged from the determined number of pumps 20 in the determined order in low and medium load operation of the engine.

Figure 3:
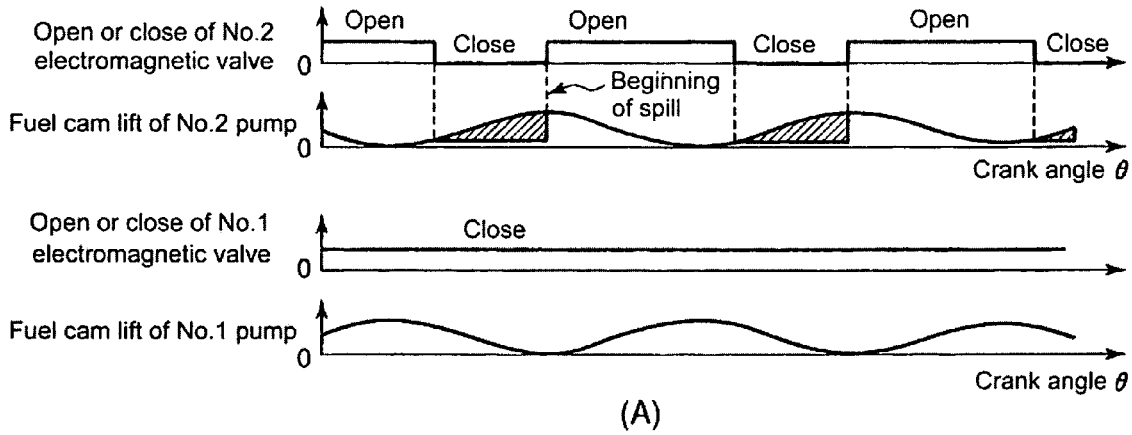
FIG. 3A is a diagram showing fuel cam lift, opening/closing of the electromagnetic valve, and state of fuel spilling from the plunger room through the inlet/spill port of the plunger barrel vs. crankshaft rotation angles in the case of embodiment of the invention.
FIG. 3B is a drawing as in FIG. 3A in the case of an apparatus of prior art.
Figure 3:
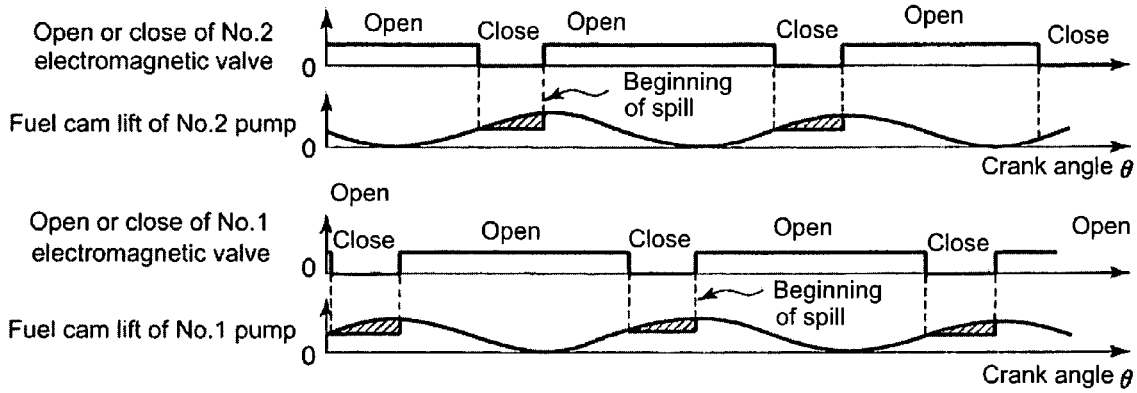

FIG. 3 are diagrams showing fuel cam lift, opening/closing of the electromagnetic valve, and state of fuel spilling from the plunger room through the inlet/spill port of the plunger barrel vs. crankshaft rotation angles of two high pressure fuel pumps of No. 1 pump and No. 2 pump. FIG. 3A shows a case when the No. 2 pump is made operative in discharging fuel to the common rail 7 and the No. 1 pump is made inoperative in discharging fuel to the common rail 7. In this case, the electromagnetic valve 2 of the No. 2 pump is closed in the up stroke of the fuel cam 4 poppet from near zero lift of the fuel cam 4 until the maximum lift thereof to discharge a quantity of fuel including a quantity of fuel that was conventionally discharged from the No. 1 pump, whereas the electromagnetic valve 1 of the No. 1 pump is always opened and fuel is not discharged to the common rail 7 from the No. 1 pump.

FIG. 3B shows a case of the conventional apparatus, in which required quantity of fuel is supplied by the No. 1 and No. 2 pumps. In this case, a part of cam lift of each of fuel cams is utilized to discharge fuel from the No. 1 and No. 2 high pressure fuel pumps.

Figure 4:
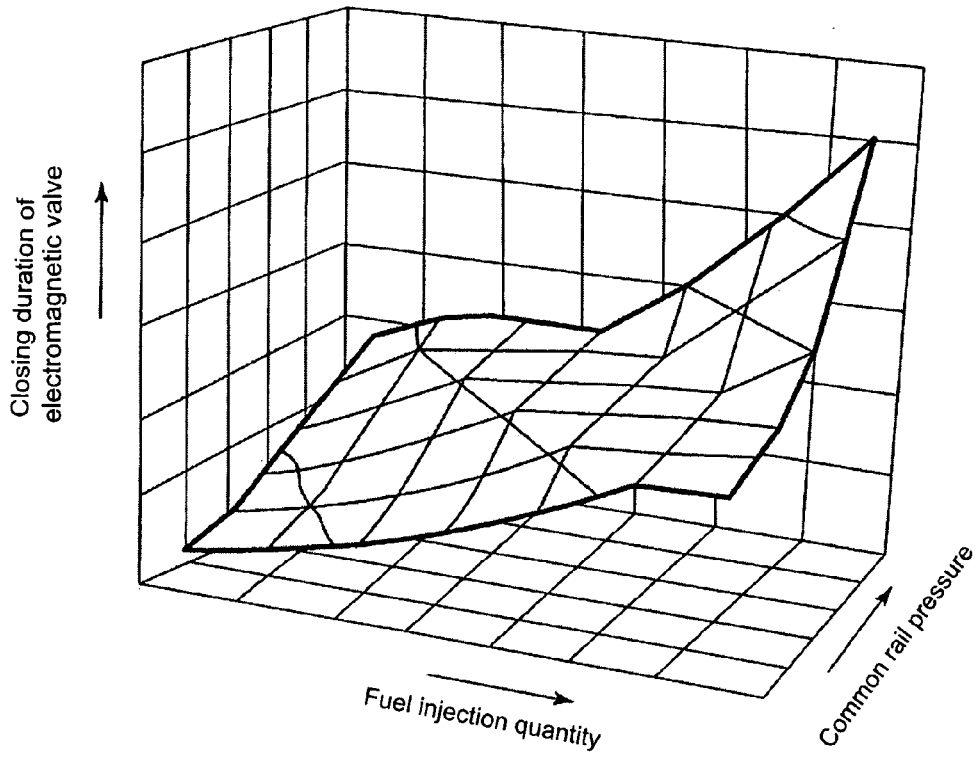
FIG. 4 is an operation characteristic diagram (1) in the embodiment.
Figure 5:
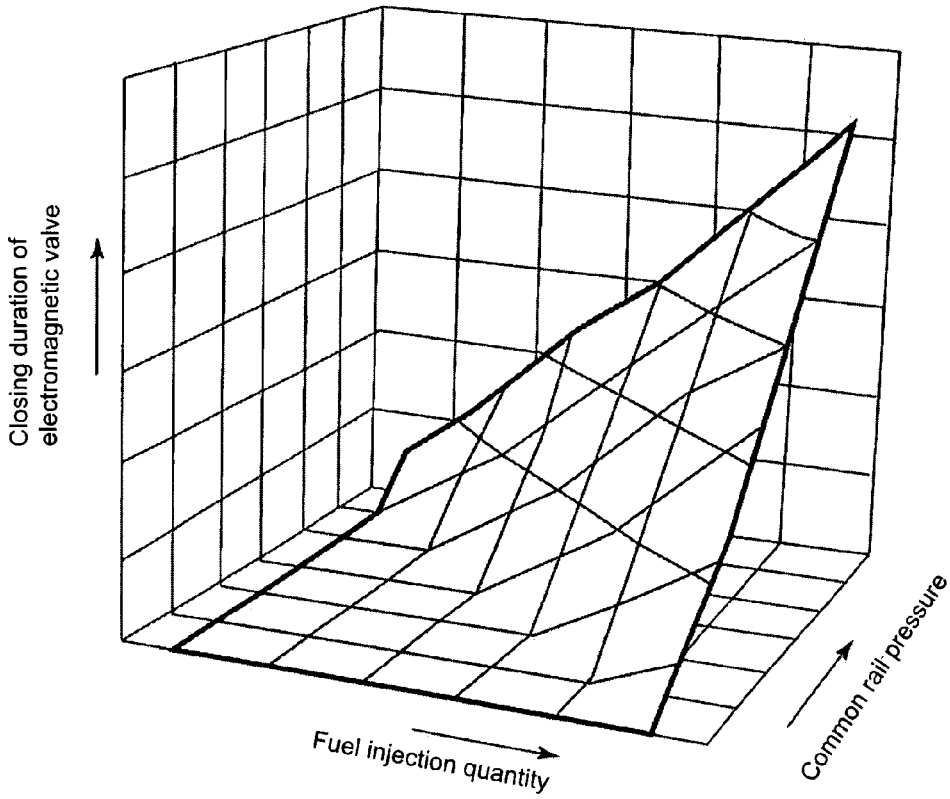
FIG. 5 is an operation characteristic diagram (2) in the embodiment.

FIGS. 4 and 5 are control maps showing fuel injection quantity-common rail pressure-electromagnetic valve closing period (discharge period of high pressure fuel pump) when the No. 1 high pressure fuel pump is made operative and No. 2 high pressure fuel pump is made inoperative. FIG. 4 is a control map of the No. 2 high pressure fuel pump and FIG. 5 is a control map of the No. 1 high pressure fuel pump. Referring to FIG. 5 as an example to explain the maps, when common rail pressure is low, the No. 1 high pressure fuel pump is made inoperative in a range of small and medium fuel injection quantity, and when common rail pressure is medium, the No. 1 high pressure fuel pump is made inoperative in a range of small fuel injection quantity.

Figure 6:
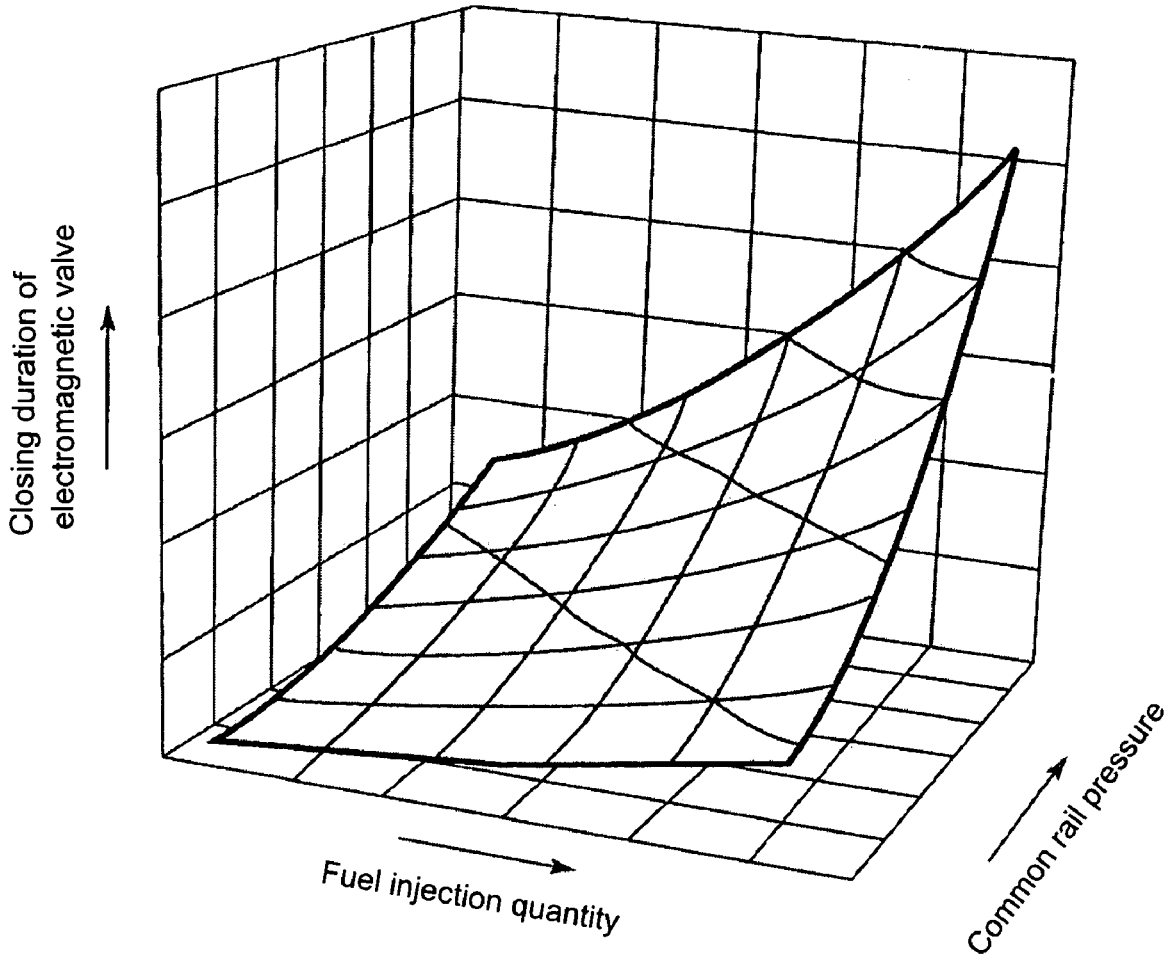
FIG. 6 is an operation characteristic diagram in the prior art.

FIG. 6 shows a control map when both the No. 1 and No. 2 pumps are made operative, as is the case of the conventional apparatus.

As has been shown in FIG. 3A, FIG. 3B and FIGS. 4 to 6, in the embodiment of the invention, a quantity of fuel the same as that discharged by No. 1 and No. 2 high pressure fuel pumps in the conventional apparatus is discharged to the common rail by utilizing the plunger stroke of the No. 2 high pressure fuel pump from near zero to the maximum, so fuel spilling occurs only in No. 2 high pressure fuel pump, and total number of times of fuel spilling can be reduced.

In the embodiment, it is possible to compose the controller 100 such that order of high pressure fuel pumps 20 to be made inoperative when common rail pressure is lower than a certain pressure is predetermined, and the electromagnetic valves 1 are operated according to the predetermined order to make relevant high pressure fuel pump inoperative.

By making each of the high pressure pumps 20 inoperative in determined order like this when common rail pressure is low/medium, uneven operation of a specific high pressure fuel pump can be evaded, occurrence of wear and erosion to the plunger of the specific pump can be prevented, resulting in elongated life time of the high pressure fuel pumps 20.

According to the embodiments, when the engine is operated under a range of load lower than a certain load (low/medium load), i.e. when fuel injection quantity is smaller than a certain quantity, or common rail pressure is lower than a certain pressure (low/medium pressure), the controller 100 controls electromagnetic valves 1 of some (No. 1 pump for example) of the plurality of high pressure pumps 20 to open the poppet valves 1*a* thereof so that the plunger rooms thereof are communicated to fuel feed/spill sides thereof to make the relevant pumps inoperative in discharging fuel to the common rail 7, so the amount of fuel spilled from the plunger rooms when the electromagnetic valves are opened at the end of fuel discharge is reduced as compared with the apparatus of prior art, for the pumps made inoperative do not spill fuel.

That is, according to the embodiments, when operating the engine under a range of low/medium load, some (No. 1 pump, for example) of the high pressure fuel pumps 20 is made inoperative by opening the relevant electromagnetic valves 1, and the remaining high pressure pumps (No. 2 pump, for example) discharge to the common rail 7 fuel of quantity required to allow fuel injection quantity corresponding to engine load to be injected into the cylinders. By this, required quantity of fuel is discharged from the remaining high pressure pumps, and spilling of fuel from the pumps made inoperative (No. 1 pump, for example) do not occur which occurred conventionally, so energy wasted by spilling of fuel from the pumps made inoperative which occurs in the apparatus of prior art is saved.

Therefore, energy wasted by allowing high pressure fuel remaining in the plunger rooms 3 to spill to the fuel feed/spill side is reduced as compared with the conventional art, and energy for driving the high pressure fuel pumps 20 can be reduced, resulting in increased energy efficiency of the fuel injection apparatus.

Required quantity of fuel to be supplied to the common rail to allow injection quantity of fuel needed to be injected into the engine cylinders, can be discharged from the pumps made operative (No. 1 pump, for example) by increasing discharge quantity of each of the pumps made operative.

Further, by controlling the electromagnetic valves 1 such that each of the high pressure pumps 20 is made inoperative in predetermined order when common rail pressure is low/medium, uneven operation of a specific high pressure fuel pump can be evaded, occurrence of wear and erosion to the plunger of the specific pump can be prevented, resulting in elongated life time of the high pressure fuel pumps 20.

Further, as shown in FIG. 1, the discharge pressure sensor 13 is provided to each of the high pressure fuel pumps 20 to detect discharge fuel pressure, and detected discharge pressure of each pump is inputted to the controller 100. When abnormality is detected in the fuel discharge pressure in any of the high pressure fuel pumps 20, the controller 100 makes operative those pumps other than the pumps of which discharge fuel pressure is detected to be abnormal.

With the composition, high pressure fuel pumps abnormal in operation such as abnormally reduced in discharge fuel pressure can be detected early by pressure detected by the discharge pressure detecting sensors 13, and stable operation of the engine can be continued by excluding the abnormal pumps from operation.

Further, it is possible to compose such that fuel pumps' abnormality detecting means (not shown in the drawing) which detect abnormality in the high pressure fuel pumps are provided other than the discharge fuel pressure sensors 13 so that the detecting means input detected result to the controller 100, and the controller 100 controls upon receiving the detected result to make the pumps detected abnormal inoperative, and at the same time restricts maximum output (maximum fuel injection quantity) in accordance with the number of high pressure fuel pump made inoperative.

With the composition, burdens on normally operating high pressure fuel pumps can be restricted by restricting maximum engine output, operation of the high pressure fuel pumps can be continued in safety, and stable engine operation can be continued.

According to the invention, some of a plurality of high pressure fuel pumps are made inoperative in discharging fuel to a common rail by opening electromagnetic valves of relevant pumps to allow the plunger rooms of the relevant pumps to be communicated with a fuel feed line when the engine is operated under a range of low/medium load, so quantity of fuel spilled to the fuel feed line when the electromagnetic valves are opened at the end of fuel discharge of each of the high pressure fuel pumps can be reduced as compared with the apparatus of prior art, because the fuel spilling does not occur in the pumps made inoperative.

Therefore, energy wasted by allowing high pressure fuel to spill out when the electromagnetic valves are opened at the end of fuel discharge of each of the high pressure fuel pumps is reduces as compared with the apparatus of prior art, so energy for driving the high pressure fuel pumps can be reduced, resulting in increased energy efficiency of the fuel injection apparatus.

The invention claimed is:

1. A fuel injection apparatus for engines comprising a plurality of high pressure fuel pumps in each of which fuel supplied to a plunger room is compressed by a plunger driven by a fuel cam to reciprocate in a plunger barrel, the compressed fuel being discharged to a common rail at timing controlled by an electromagnetic valve, high pressure fuel accumulated in the common rail being injected into cylinders of an engine through injection valves at controlled timing, wherein a controller is provided which allows some of the plurality of high pressure fuel pumps to be made inoperative in discharging fuel to the common rail by controlling the electromagnetic valves of said some of the pumps so that the plunger rooms of said some of the pumps are communicated to a fuel feed line for feeding fuel to the plurality of the pumps when the engine is operated with small/medium fuel injection quantity of smaller than a certain quantity, and further wherein when the engine is operated under low/medium engine loads, some of the plurality of high pressure fuel pumps are made inoperative in accordance with a result of a calculation of a number of the high pressure fuel pumps needed for injecting the fuel injection quantity corresponding to said low/medium engine loads.

2. A fuel injection apparatus as claimed in claim 1, wherein a pressure detector for detecting pressure in the common rail and inputting it to the controller, whereby the controller controls based on pressure in the common rail detected by said pressure detector the electromagnetic valves of said some of the pumps so that said some of the pumps are made inoperative in discharging fuel to the common rail when pressure in the common rail is lower than a certain pressure in low/medium load operation of the engine.

3. A fuel injection apparatus as claimed in claim 2, wherein said some of the plurality of high pressure fuel pumps are made inoperative in discharging fuel to the common rail by always closing the electromagnetic valve of said some of the pumps so that fuel supply to the plunger rooms of said some of the pumps is interrupted.

4. A fuel injection apparatus as claimed in claim 1, wherein abnormality detecting means for detecting abnormality of each of the plurality of high pressure fuel pumps and inputting the result of detection to the controller are provided, whereby the controller controls such that high pressure fuel pumps other than those pumps that are detected abnormal when the engine is operated with small/medium fuel injection quantity are made operative.

5. A fuel injection apparatus as claimed in claim 1, wherein abnormality detecting means for detecting abnormality of each of the plurality of high pressure fuel pumps and inputting the result of detection to the controller are provided, whereby the controller controls the high pressure fuel pumps so that maximum output of the engine is restricted in accordance with the number of high pressure fuel pumps detected abnormal by the abnormality detecting means when the engine is operated with small/medium fuel injection quantity.

6. A fuel injection apparatus for engines comprising a plurality of high pressure fuel pumps in each of which fuel supplied to a plunger room is compressed by a plunger driven by a fuel cam to reciprocate in a plunger barrel, the compressed fuel being discharged to a common rail at timing controlled by an electromagnetic valve, high pressure fuel accumulated in the common rail being injected into cylinders of an engine through injection valves at controlled timing, wherein a controller is provided which allows some of the plurality of high pressure fuel pumps to be made inoperative in discharging fuel to the common rail by controlling the electromagnetic valves of said some of the pumps so that the plunger rooms of said some of the pumps are communicated to a fuel feed line for feeding fuel to the plurality of the pumps when the engine is operated with small/medium fuel injection quantity of smaller than a certain quantity, wherein the controller determines beforehand order of the high pressure fuel pumps to be made inoperative in discharging fuel to the common rail when pressure in the common rail is in a range of low/medium pressure and controls the electromagnetic valves so that the high pressure fuel pumps are made inoperative in the predetermined order.

7. A fuel injection apparatus for engines comprising a plurality of high pressure fuel pumps in each of which fuel supplied to a plunger room is compressed by a plunger driven by a fuel cam to reciprocate in a plunger barrel, the compressed fuel being discharged to a common rail at timing controlled by an electromagnetic valve, high pressure fuel accumulated in the common rail being injected into cylinders of an engine through injection valves at controlled timing, wherein a controller is provided which allows some of the plurality of high pressure fuel pumps to be made inoperative in discharging fuel to the common rail by controlling the electromagnetic valves of said some of the pumps so that the plunger rooms of said some of the pumps are communicated to a fuel feed line for feeding fuel to the plurality of the pumps when the engine is operated with small/medium fuel injection quantity of smaller than a certain quantity, wherein there is further a pressure detector for detecting pressure in the common rail and inputting it to the controller, whereby the controller controls based on pressure in the common rail detected by said pressure detector the electromagnetic valves of said some of the pumps so that said some of the pumps are made inoperative in discharging fuel to the common rail when pressure in the common rail is lower than a certain pressure in low/medium load operation of the engine, and wherein the controller determines beforehand order of the high pressure fuel pumps to be made inoperative in discharging fuel to the common rail when pressure in the common rail is in low/medium range and controls the electromagnetic valves to make the high pressure fuel pumps inoperative in discharging fuel to the common rail in the predetermined order.

8. A fuel injection apparatus as claimed in claim 7, wherein said abnormality detecting means are discharge pressure detecting means each of which detects discharge pressure of each of the plurality of high pressure fuel pumps and inputs the detected pressure to the controller.

9. A method of controlling fuel injection apparatus for engines, the fuel injection apparatus comprising a fuel feeding line, a fuel cam, a common rail, a plurality of high pressure fuel pumps, and an electronic valve associated with each high pressure fuel pump that includes a plunger room, a plunger, and a plunger barrel, the method comprising a normal operation of:

controlling supply of fuel to the plunger room of each high pressure fuel pump from the fuel feeding line using the electronic valve associated with that high pressure fuel pump;

compressing the fuel in each plunger room by driving the plunger via the fuel cam to move in the plunger barrel to form high pressure fuel;

supplying the high pressure fuel from each high pressure fuel pump plunger room to the common rail via the electronic valve; and injecting the high pressure fuel accumulated in the common rail into cylinders of an engine through injection valves at controlled timing, and a conditional operation of:

controlling a predetermined one or more of the plurality of high pressure fuel pumps by selectively controlling the electromagnetic valves associated with the predetermined one or more of said high pressure fuel pumps so that plunger rooms of said one or more of the high pressure fuel pumps are communicated to the fuel feed line and high pressure fuel is supplied to the common rail by the remaining high pressure fuel pumps being normally controlled by the electromagnetic valves associated therewith when the engine is operated under a condition of low/medium engine loads lower than a predetermined load wherein when the engine is operated under said low/medium engine loads, some of the plurality of high pressure fuel pumps are made inoperative in accordance with a result of a calculation of a number of the high pressure fuel pumps needed for injecting the fuel injection quantity corresponding to said low/medium engine loads.

* * * * *